US005723278A

United States Patent [19]

Jagannathan et al.

[11] Patent Number: 5,723,278

[45] Date of Patent: Mar. 3, 1998

[54] TABULAR GRAIN EMULSIONS WITH SELECTED SITE HALIDE CONVERSIONS AND PROCESSES FOR THEIR PREPARATION

[75] Inventors: Seshadri Jagannathan, Rochester; David E. Fenton, Fairport; Samuel Chen, Penfield, all of N.Y.

[73] Assignee: Eastman Kodak Company, Rochester, N.Y.

[21] Appl. No.: 657,827

[22] Filed: May 31, 1996

Related U.S. Application Data

[60] Provisional application No. 60/000,774, Jun. 30, 1995.

[51] Int. Cl.[6] ..... G03C 1/015; G03C 1/035

[52] U.S. Cl. ..... 430/567; 430/569

[58] Field of Search ..... 430/567, 569

[56] References Cited

U.S. PATENT DOCUMENTS

| | | | |
|---|---|---|---|
| 4,806,461 | 2/1989 | Ikeda et al. | 430/567 |
| 5,096,806 | 3/1992 | Nakamura et al. | 430/567 |
| 5,498,516 | 3/1996 | Kikuchi et al. | 430/567 |
| 5,550,014 | 8/1996 | Marurama et al. | 430/567 |

FOREIGN PATENT DOCUMENTS

| | | | |
|---|---|---|---|
| 4-140737 | 5/1992 | Japan | G03C 1/035 |
| 4-149541 | 5/1992 | Japan | G03C 1/035 |

*Primary Examiner*—Mark F. Huff
*Attorney, Agent, or Firm*—Carl O. Thomas

[57] ABSTRACT

A radiation-sensitive photographic emulsion is disclosed containing a gelatino-vehicle and tabular grains accounting for at least 70 percent of total grain projected area comprised of, prior to house conversion, at least 90 mole percent bromide and, after house conversion, up to 12 mole percent iodide, based on total silver, having {111} major faces that form corners joined by linear edges, and containing halide conversion dislocations that are confined to corner regions.

Superior performance and selected site halide conversion can be realized by maintaining a pBr of less than 3.5 and by employing for halide conversion an iodide ion source exhibiting a second order reaction rate constant with the gelatino-vehicle of less than $10^{-3}$ mole$^{-1}$ sec$^{-1}$.

10 Claims, 1 Drawing Sheet

TABULAR GRAIN EMULSIONS WITH SELECTED SITE HALIDE CONVERSIONS AND PROCESSES FOR THEIR PREPARATION

CROSS REFERENCE TO RELATED APPLICATION

Reference is made to and priority claimed from U.S. Provisional Application Serial No. US 60/000,774, filed 30 Jun., 1995, entitled TABULAR GRAIN EMULSIONS WITH SELECTED SITE HALIDE CONVERSIONS AND PROCESSES FOR THEIR PREPARATION.

FIELD OF THE INVENTION

The invention relates to radiation-sensitive silver halide emulsions useful in photography and to processes for their preparation.

BACKGROUND

Silver halide emulsions contain silver halide grains in a dispersing medium, which typically contains a gelatino-vehicle. Although the majority of the silver and halide ions are confined to the grains, at equilibrium a small fraction of the silver and halide ions are also present in the dispersing medium, as illustrated by the following relationship:

$$Ag^+ + X^- \rightleftharpoons AgX \quad \text{(I)}$$

where X represents halide. From relationship (I) it is apparent that most of the silver and halide ions at equilibrium are in an insoluble form while the concentration of soluble silver ions ($Ag^+$) and halide ions ($X^-$) is limited. However, it is important to note that equilibrium is a dynamic relationship—that is, a specific halide ion is not fixed in either the right hand or left hand position in relationship (I). Rather a constant interchange of halide ion between the left and right hand positions is occurring.

At any given temperature the activity product of $Ag^+$ and $X^-$ is at equilibrium a constant and satisfies the relationship:

$$Ksp=[Ag^+][X^-] \quad \text{(II)}$$

where Ksp is the solubility product constant of the silver halide. To avoid working with small fractions the following relationship is also widely employed:

$$-\log Ksp=pAg+pX \quad \text{(III)}$$

where pAg represents the negative logarithm of the equilibrium silver ion activity and pX represents the negative logarithm of the equilibrium halide ion activity.

From relationship (III) it is apparent that the larger the value of the −log Ksp for a given halide, the lower is its solubility. The relative solubilities of the photographic halides (Cl, Br and I) can be appreciated by reference to Table I:

TABLE I

| Temp. °C. | AgCl −log Ksp | AgBr −log Ksp | AgI −log Ksp |
|---|---|---|---|
| 40 | 9.2 | 11.6 | 15.2 |
| 50 | 8.9 | 11.2 | 14.6 |
| 60 | 8.6 | 10.8 | 14.1 |
| 80 | 8.1 | 10.1 | 13.2 |

From Table I it is apparent that at 40° C. the solubility of AgCl is one million times higher than that of silver iodide, while the solubility of AgBr ranges from about one thousand to ten thousand times that of AgI.

It is known that the properties of silver-halide grains can be modified by halide conversion. This is accomplished by introducing into a silver halide emulsion halide ions that have a lower solubility than halide ions contained in the grains. For example, silver chloride grains can be transformed into converted halide grains by the introduction of bromide and/or iodide ions. Similarly, silver bromide grains can be transformed into converted halide grains by the introduction of iodide ions.

As a less soluble halide ion replaces a more soluble halide ion in the crystal lattice of the silver halide grain, a disruption of the crystal lattice occurs, since the reduction in silver halide solubility in progressing from chloride to bromide to iodide ions is also accompanied by an increase in the physical size of the ions. Halide conversion is known to create crystal lattice dislocations.

An early use of converted halide emulsions was to create silver halide grains that would, by reason of the internal crystal lattice disruptions, form latent image sites predominantly within the interior of the grains. Thus their use was primarily as direct positive emulsions, but they have also been used to advantage as negative working emulsions.

When interest developed in tabular grain emulsions in the early 1980's, halide conversions of tabular grains of the type previously practiced on conventional nontabular grains were observed to degrade or destroy the tabular character of the grains. Thus, halide conversions of tabular grains were initially avoided.

Ikeda et al U.S. Pat. No. 4,806,461 reported that when at least 50 percent of total grain projected area is accounted for by tabular grains containing 10 or more dislocations per grain improved photographic sensitivity is observed. The dislocations reported by Ikeda et al were more or less randomly distributed over the major faces of the tabular grains.

Nakamura et al U.S. Pat. No. 5,096,806 discloses a tabular grain emulsion that has been modified by halide conversion to create a somewhat higher concentration of iodide ions in the vicinity of the grain corners than elsewhere along their edges. From the Examples it is apparent that the iodide content is only slightly higher in the corner regions than elsewhere along the grain edges. Examples 1 and 2 show corner region iodide concentrations of 9.8 and 10.1 mole percent versus edge region iodide concentrations of 7.1 mole percent.

Suga and Maruyama Japanese Kokai 4[1992]-149737 and Maruyama Japanese Kokai 4[1992]-149541 suggest that tabular grains with superior sensitivity can be realized by increasing the concentration of dislocations in the vicinity of their corners. Dislocations are created by halide conversion with iodide ions. Through a combination of (a) loosely defining the corner regions of the grains to extend up to half the distance from the corner to the center of the grains and (b) indicating that the concentration of dislocations in non-corner regions of the grains can be up to half that of the corner regions, these teachings leave little doubt but that halide conversion takes place and grain dislocations are created in portions of the grains other than the corner regions.

A further problem with the teachings of Suga and Maruyama is that silver chloride epitaxy is employed to provide favored sites for initiating halide conversion. Unfortunately, the epitaxial deposits are themselves nontabular and their addition to the host grains degrades their tabular character.

Fenton et al U.S. Ser. No. 329,591, filed Oct. 26, 1994, now U.S. Pat. No. 5,476,760, commonly assigned, titled PHOTOGRAPHIC EMULSIONS OF ENHANCED SENSITIVITY, discloses tabular grain emulsions with a lower iodide concentration adjacent their corners than elsewhere along their edges. Iodide ions can be provided by soluble iodide salts, by fine silver iodide grains or by release from organic iodides.

RELATED APPLICATION

Black et al U.S. Ser. No. 399,798, filed Mar. 7, 1995, commonly assigned, titled TABULAR GRAIN EMULSIONS EXHIBITING RELATIVELY CONSTANT HIGH SENSITIVITIES, discloses increased sensitivity and reduced pressure sensitivity when tabular grains having an average equivalent circular diameter (ECD) of at least 2.0 μm are formed with a lower concentration of dislocations in a central region than in a peripheral region. Iodide ions are provided by limited concentrations of fine silver iodide grains.

SUMMARY OF THE INVENTION

Figure 1:
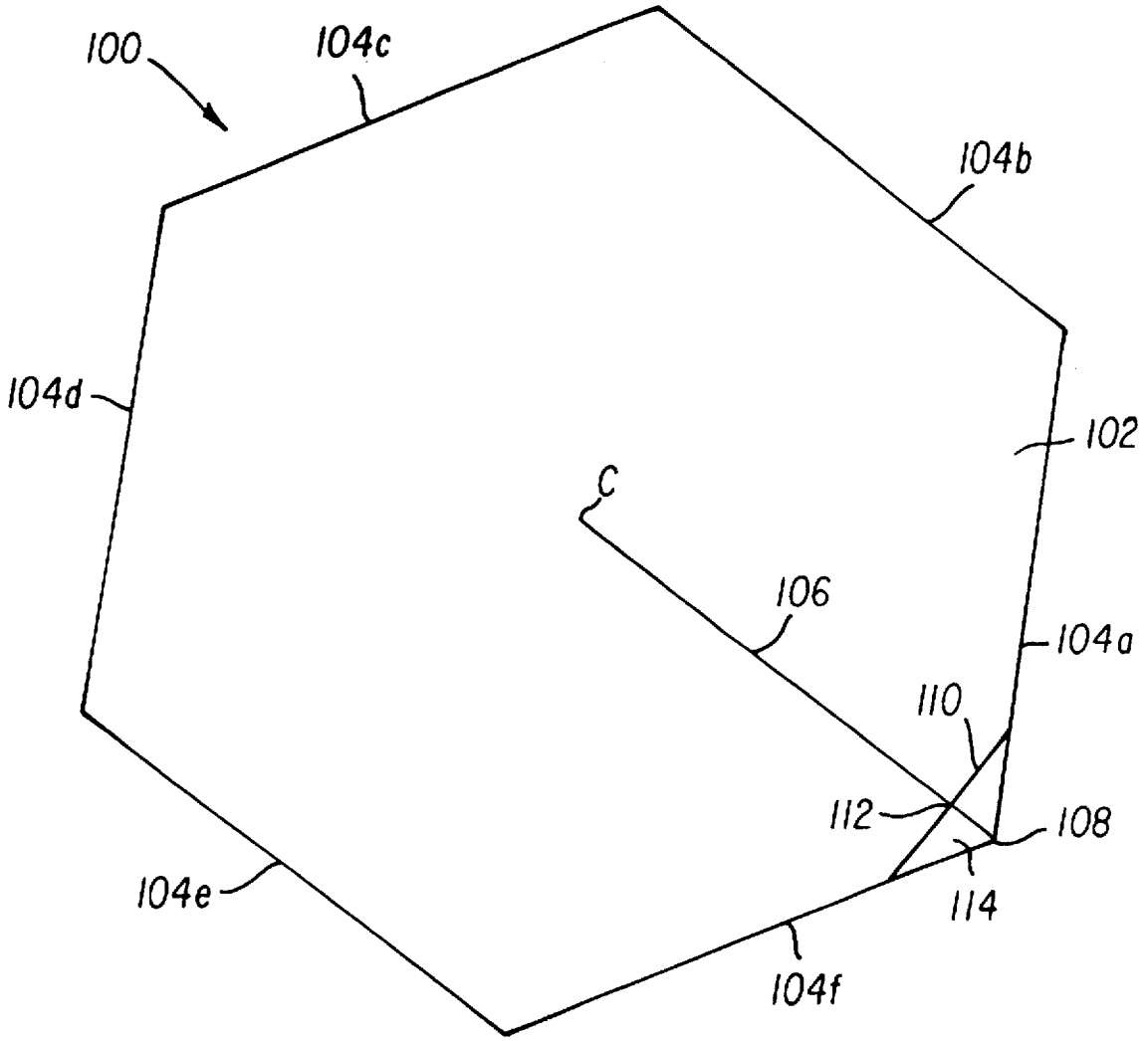
FIG. 1 is a plan view of a tabular grain, showing the demarcation between a corner region and the remainder of the tabular grain.

Although it has been recognized that the sensitivity of tabular grain emulsions can be improved by selective iodide and/or dislocation siting at corner sites within tabular grains, the halide conversion techniques that have been available merely increase somewhat the siting of iodide and/or dislocations at the corners of tabular grains and fall well short of placing iodide and/or dislocations exclusively within the corner regions of tabular grains accounting for at least 50 percent of total grain projected area.

The present invention provides a process for the halide conversion of tabular grain emulsions that achieves selective displacement of halide ions with iodide ions within the corner regions of high bromide tabular grains accounting for at least 70 percent of the total grain projected area of the emulsion in which they are contained. Both the process for achieving exclusive siting of halide conversion dislocations within the corner regions of tabular grains accounting for at least 70 percent of total grain projected area and the emulsions that result are the subject of this invention.

In one aspect, this invention is directed to a halide conversion process comprised of (1) providing a radiation-sensitive emulsion containing a gelatino-vehicle and silver halide grains and (2) introducing iodide ions into the grains, wherein (3) the radiation-sensitive emulsion as provided includes tabular grains which (a) are comprised at least 90 mole percent bromide and up to 10 mole percent iodide, based on silver, and (b) have {111} major faces that (i) form corners joined by linear edges and (ii) account for at least 70 percent of total grain projected area, (4) the pBr of the emulsion provided is maintained at less than 3.5, (5) an iodide ion source exhibiting a second order reaction rate constant with the gelatino-vehicle of less than $10^{-3}$ $mole^{-1}$ $sec^{-1}$ is introduced into the emulsion and reacted with the gelatino-vehicle to release iodide ions, and (6) the released iodide ions selectively displace halide ions to create dislocations confined to corner regions of the tabular grains, the boundary between each corner region and the remainder of the tabular grain of which the corner region forms a part being delineated by a plane that perpendicularly intersects an axis extending from the center of a {111} major face of the tabular grain to the tabular grain corner within the corner region at a distance from the corner which is 10 percent of the length of the axis.

In another aspect, this invention is directed to a radiation-sensitive emulsion containing a gelatino-vehicle and silver halide grains wherein the grains are comprised of tabular grains accounting for at least 70 percent of total grain projected area (1) comprised of, prior to halide conversion, at least 90 mole percent bromide and after halide conversion up to 12 mole percent iodide, based on total silver, (2) having {111} major faces that form corners joined by linear edges, and (3) containing halide conversion dislocations that are confined to corner regions, the boundary between each corner region and the tabular grain of which it forms a part being delineated by a plane that perpendicularly intersects an axis extending from the center of a {111} major face of the tabular grain to the tabular grain corner of the corner region at a distance from the corner which is 10 percent of the length of the axis.

The invention offers a number of advantages that can be realized in one or more of its various forms. By avoiding the use of silver halide epitaxy for corner siting, the formation of nontabular protrusions on the tabular grains that can degrade the desired tabular structural form (morphology) of the grains is avoided. Exclusively siting the halide conversion dislocations in the corner regions of the tabular grains utilizes the dislocations with maximum efficiency, since the corner region siting of the dislocations represents optimum siting for sensitivity enhancement. Keeping the remaining (non-corner) regions of tabular grains free of halide conversion dislocations avoids unwanted variance in sensitivity as a function of locally applied pressure (herein referred to as unwanted pressure sensitivity) and also preserves the integrity of the tabular grain structure—i.e., enhances tabular grain morphology. For example, any tendency toward toughening of the major faces of the tabular grains or reversion of the tabular grains to nontabular forms by halide conversion is entirely avoided when the majority of the major faces contain no halide conversion dislocations.

By employing iodide ion sources exhibiting lower reaction rate constants than conventional iodide ion sources, control over halide conversion is facilitated and improved. In many emulsion precipitations an exact set of conditions will produce a desired result, but any one or combination of small inadvertent manufacturing variances from these conditions have a large and unwanted impact on the characteristics of the emulsion obtained. The halide conversion process of the invention is more robust (i.e., less subject to product variance as a function of inadvertent manufacturing variances in precipitation conditions). Specifically, the slower release of iodide ion enhances manufacturing robustness. With slower rates of iodide ion release batch-to-batch and scale-to-scale variances in emulsion properties are reduced, and the impact of varied stirring rates during halide conversion is reduced.

With specific, preferred choices of iodide ion source materials iodide release does not produce any by-product requiring subsequent elimination from the emulsion (e.g., by a subsequent washing step). It is, in fact, contemplated to modify usefully the gelatino-vehicle in the halide conversion operation.

Additionally, it has been recognized that superior photographic performance is realized when pBr levels are maintained at less than 3.0 during halide conversion.

DESCRIPTION OF PREFERRED EMBODIMENTS

The present invention is directed to improved processes for achieving the halide conversion of high bromide {111} tabular grain emulsions and to novel converted halide emulsions that these processes make possible.

As employed herein the term "high bromide" refers to silver halide grains or emulsions that contain at least 90 mole percent bromide, based on total silver. Contemplated silver halide compositions of the tabular grains provided for halide conversion are silver bromide, silver iodobromide, silver chlorobromide, silver iodochlorobromide and silver chloroiodobromide emulsions. In referring to silver halide grains or emulsions containing two or more halides, the halides are named in order of ascending concentrations. Silver bromide emulsions represent one specifically preferred tabular grain emulsion selection for halide conversion.

Since halide conversion increases the level of iodide within the tabular grains, it is preferred that the tabular grains initially contain no more than 10 mole percent iodide. Halide conversion can be achieved when the tabular grains contain higher levels of iodide, particularly when the higher levels of iodide are confined to the interior of the tabular grains, but maximum photographic advantages are realized when iodide is initially limited. It is specifically preferred that the tabular grains initially contain less than 5 mole percent iodide. It is also preferred that the distribution of surface iodide be uniform. The reason for this is that the presence of iodide ions in the tabular grains is in itself somewhat disruptive of the face centered cubic rock salt structure of the crystal lattice provided by bromide (optionally in combination with chloride) ions. Uniform distribution at or near the grain surface as well as limiting iodide surface concentrations assures that iodide initially in the tabular grain structure minimally influences subsequent halide conversion. As most conveniently formed the tabular grains provided for halide conversion contain iodide that is uniformly distributed throughout the grain.

Any amount of chloride can be initially present in the tabular grains that is consistent with the stated ranges of initial bromide and iodide concentrations. Chloride when present is preferably uniformly distributed at the grain surfaces and, most preferably, throughout the grains.

As employed herein the term "tabular grain" is employed to identify a grain that has two parallel major faces that are clearly larger than any remaining faces of the grain and that exhibits an aspect ratio of at least 2. Aspect ratio is the quotient of tabular grain equivalent circular diameter (ECD) divided by tabular grain thickness (t).

It is contemplated that the tabular grains satisfying {111} major face and composition requirements account for at least 70 percent (preferably at least 90 percent) of total grain projected area. For maximum specular transmission it is specifically preferred that substantially all (e.g., >97%) of total grain projected area be accounted for by tabular grains.

The tabular grain emulsions selected for halide conversion can have mean ECD's, tabular grain thicknesses and aspect ratios of any conventional value. For photographic utility mean ECD's cannot exceed 10 μm. In fact, in the vast majority of tabular grain emulsions mean ECD's are less than 5 μm. Minimum ECD's are determined by the minimum aspect ratio of 2 and the mean thickness of the tabular grains.

It is generally preferred that tabular grains having a thickness of less than 0.3 μm account for at least 70 percent of total grain projected area. Most commonly preferred are thin tabular grain emulsions, those in which tabular grains having a thickness of less than 0.2 μm account for at least 70 percent of total grain projected area. Recently interest has developed in ultrathin tabular grain emulsions, particularly for minus blue (green and/or red) recording. Ultrathin tabular grain emulsions are those in which tabular grains having a thickness of less than 0.07 μm account for at least 70 percent of total grain projected area.

It is additionally preferred in selecting high bromide tabular grain emulsions for halide conversion to limit grain dispersity. It is preferred that the coefficient of variation (COV) of grain ECD be less than 30 percent, most preferably less than 20 percent. With care high bromide tabular grain emulsions can be prepared with COV's of less than 10 percent.

The tabular grain emulsions upon which halide conversion is practiced are those in which the tabular grains have {111} major faces that form corners joined by linear edges. The {111} major faces of the tabular grains lie in {111} atomic planes. Typically these tabular grains in their most regular form have hexagonal major faces. Tabular grains with triangular {111} major faces are also quite common. Somewhat less common, but also known, are tabular grains with trapezoidal (truncated triangle) major faces. Tabular grains almost always exhibit some rounding at their corners due to ripening. However, in the emulsions of the invention, both before and after halide conversion, corner rounding is limited so that linear edges joining the corners are always in evidence. For example, tabular grains with several corners and linear edges approximating those of a hexagonal major face, but also including a rounded edge or edges resulting in less than 6 corners and 6 linear edges are specifically excluded from the tabular grains required to account for at least 70 percent of total grain projected area. Although corner regions of tabular grains are almost always visually apparent upon viewing magnifications of tabular grain major faces, to provide a quantitative criterion for identifying a tabular grain corner, the corner of a tabular grain is defined as an edge region of a {111} major face that exhibits (or approximates) a radius of curvature that is less than half the radius (ECD÷2) of the tabular grain {111} major face—i.e., less than the tabular grain ECD÷4. Linear edges are those that extend from one corner region to the next without interruption and are linear in appearance.

It is additionally preferred that the tabular grains of the emulsions selected for halide conversion according to the teachings of the invention contain a minimal number of dislocations in their {111} major faces. For example, it is specifically preferred that the tabular grains that account for at least 70 percent (most preferably at least 90 percent) of total grain projected area contain fewer than 10 dislocations per grain. Preferably the tabular grains accounting for at least 70 percent (most preferably at least 90 percent) of total grain projected area are free of observable dislocations. Exemplary descriptions of grain dislocations and their observation are provided by (1) C. R. Berry, *J. Appl. Phys.*, 27, 636 (1956);

(2) C. R. Berry, D. C. Skillman, *J. Appl. Phys.*, 35, 2165 (1964);

(3) J. F. Hamilton, *Phot. Sci. Eng.*, 11, 57 (1967);
(4) T. Shiozawa, *J. Soc. Phot. Sci. Japan*, 34, 16 (1971);
(5) T. Shiozawa, *J. Soc. Phot. Sci. Japan*, 35, 213 (1972);
(6) Ikeda et al U.S. Pat. No. 4,806,461;
(7) Suga and Maruyama Japanese Kokai 4[1992]-149737; and
(8) Maruyama Japanese Kokai 4[1992]-149541.

In addition to the silver halide grains the emulsion selected for halide conversion includes a dispersing medium containing a gelatino-vehicle. The term "vehicle" is employed in its art recognized sense to indicate an emulsion material capable of acting as a peptizer or a binder. As employed herein the term "gelatino-vehicle" refers to gelatin (e.g., cattle bone or hide gelatin), acid-treated gelatin (e.g., pigskin gelatin), or a gelatin derivative (e.g., acetylated or phthalated gelatin). Typically the silver halide grains are precipitated in the presence of a small amount of a gelatino-vehicle, which acts as a peptizer. At or near the completion of grain precipitation it is common practice to increase the concentration of the gelatino-vehicle. Generally halide conversion as contemplated by this invention is undertaken at the conclusion of precipitation before any other steps are taken to prepare the emulsions for final use—e.g., washing, chemical and/or spectral sensitization, or incorporation of modifying addenda.

The gelatino-vehicle can, if desired, be present in combination with other conventional photographic emulsion vehicles. It is preferred that the gelatino-vehicle contain natural levels of methionine, typically in excess of 100 micromoles per gram, since these facilitate the halide conversion process of the invention. Conversely, gelatino-vehicles that have been treated with strong oxidizing agents, such as hydrogen peroxide or an alkylating agent, to eliminate methionine by oxidation are not preferred. However, the precipitation of silver halide in the presence of a low methionine peptizer is fully compatible with the practice of the invention, since additional gelatino-vehicle containing conventional, higher levels of methionine can be added at or near the conclusion of precipitation.

Various conventional forms of gelatino-vehicles are illustrated by *Research Disclosure*, Vol. 365, September 1994, Item 36544, Section II. Vehicles, vehicle extenders, vehicle-like addenda and vehicle related addenda, A. Gelatin and hydrophilic colloid peptizers. *Research Disclosure* is published by Kenneth Mason Publications, Ltd., Dudley House, 12 North St., Emsworth, Hampshire P010 7DQ, England. A more extensive discussion of gelatin and its properties is provided by James *The Theory of the Photographic Process*, 4th Ed., Macmillan, New York, 1977, Chapter 2, Gelatin.

The following are illustrations of tabular grain emulsions which can be employed for halide conversion according to the teachings of the invention:

| | |
|---|---|
| Wilgus et al | U.S. Pat. No. 4,434,226; |
| Kofron et al | U.S. Pat. No. 4,439,520; |
| Daubendiek et al | U.S. Pat. No. 4,414,310; |
| Yamada et al | U.S. Pat. No. 4,647,528; |
| Sugimoto et al | U.S. Pat. No. 4,665,528; |
| Daubendiek et al | U.S. Pat. No. 4,672,027; |
| Yamada et al | U.S. Pat. No. 4,678,745; |
| Maskasky | U.S. Pat. No. 4,684,607; |
| Daubendiek et al | U.S. Pat. No. 4,693,964; |
| Maskasky | U.S. Pat. No. 4,713,320; |
| Sugimoto | U.S. Pat. No. 4,755,456; |
| Goda | U.S. Pat. No. 4,775,617; |
| Ellis | U.S. Pat. No. 4,801,522; |
| Ohashi et al | U.S. Pat. No. 4,835,095; |
| Daubendiek et al | U.S. Pat. No. 4,914,014; |

-continued

| | |
|---|---|
| Makino et al | U.S. Pat. No. 4,835,322; |
| Saitou et al | U.S. Pat. No. 4,977,074; |
| Ikeda et al | U.S. Pat. No. 4,985,350; |
| Piggin et al | U.S. Pat. No. 5,061,609; |
| Tsaur et al | U.S. Pat. No. 5,147,771; |
| Tsaur et al | U.S. Pat. No. 5,147,772; |
| Tsaur et al | U.S. Pat. No. 5,147,773; |
| Tsaur et al | U.S. Pat. No. 5,171,659; |
| Tsaur et al | U.S. Pat. No. 5,210,013; |
| Antoniades et al | U.S. Pat. No. 5,250,403; |
| Kim et al | U.S. Pat. No. 5,272,048; |
| Sutton et al | U.S. Pat. No. 5,334,469; |
| Black et al | U.S. Pat. No. 5,334,495; |
| Delton | U.S. Pat. No. 5,372,927. |

A remarkable feature of tabular grain emulsions that have undergone halide conversion by the method of the invention is that grain dislocations produced by halide conversion are confined to corner regions of the tabular grains accounting for at least 70 (preferably at least 90) percent of total grain projected area. Whereas a grain corner is a surface feature of a grain, a corner region is a portion of a grain that lies next to and forms the corner. Although corner regions are easily identified as such by visual inspection of grain magnifications, to provide a quantitative definition, the corner region of a tabular grain is that portion of the tabular grain that lies adjacent the edges of the grain defining a corner. The corner region is separated from the remainder of the tabular grain of which it forms a part by a boundary that lies in a plane perpendicularly intersecting an axis extending from the center of a {111} major face of the tabular grain to the tabular grain corner of the corner region. The plane is located at a distance from the corner that is 10 percent of the length of the axis.

An illustration of a typical corner region and its boundary are provided in FIG. 1. A tabular grain 100 having a hexagonal major face 102 lying in a {111} atomic plane is shown with six linear edges 104*a*, 104*b*, 104*c*, 104*d*, 104*e* and 104*f*. An axis 106 is shown extending from the center C of the {111} major face to a corner 108 formed by the intersection of the edges 104*a* and 104*f*. A plane 110 is shown perpendicularly intersecting the axis at point 112. The plane is located so that the distance between corner 108 and point 112 is exactly 10 percent of the total length of the axis 106 extending from the center C and the corner 108. The plane, which extends downwardly through the thickness of the tabular grain, provides a demarcation of the corner region 114, shown as the triangular area bounded by the edges 104*a* and 104*f* and the plane 110.

In FIG. 1 there are five additional corner regions identical to corner region 114. In the grain 100 the six (6) corner regions together account for less than 2.5 percent of the total volume of the tabular grain. Thus, halide conversion is severely restricted as to the portion of the tabular grain it can occupy.

Under mild ripening conditions-some rounding of the corners is typically observed. This is because the silver and halide ions at the corners of the grains are more likely to reenter the dispersing medium than silver and halide ions elsewhere in the crystal lattice structure. Stated another way, at equilibrium with host tabular grains of uniform surface composition, the corners, the edges and the faces of the grains in descending order of activity are continually exchanging silver and halide ions with the dispersing medium as noted above in relationship (I).

It is the discovery of the present invention that halide conversion can be confined to corner regions of the tabular grains by introducing iodide ion into the emulsion under conditions that maintain the equilibrium corner preference for halide incorporation from the surrounding dispersing medium. This requires limiting the presence of free iodide ion within the dispersing medium of the emulsion.

One possible technique for accomplishing this is to introduce highly dilute solutions of iodide ion into the dispersing medium. The iodide ion that is present displaces more soluble halide ion from the tabular grains, but, by limiting the concentration of the iodide, the rate of halide conversion can be moderated to achieve halide conversion exclusively in the corner regions of the tabular grains accounting for at least 70 percent of total grain projected area. However, this approach in practice exhibits disadvantages. To confine halide conversion dislocations to the corner regions of the grains the concentration of iodide ion must be maintained at less than $10^{-5}$ molar. Therefore large amounts of diluent (typically water) must be subsequently removed from the emulsion by washing. Additionally washing is required for counter ion (e.g., ammonium or alkali cation) removal.

It has been discovered that the desired exclusive corner region halide conversion, without degradation of the desired geometrical form of the tabular grains, can be achieved without the above disadvantages by employing as an iodide ion source a compound that is capable of reacting with the gelatino-vehicle at a limited rate. Large non-equilibrium excesses of iodide ions that would cause equilibrium siting preferences to be obliterated are avoided. Also, excessive dilution of the dispersing medium is avoided. Still further, the non-iodide moiety of the iodide releasing compound is captured by the gelatino-vehicle, thereby avoiding any unwanted interaction of reaction by-products with the grains or subsequently provided addenda. This also eliminates any necessity of emulsion washing after halide conversion to remove reaction by-products.

The iodide ion source compound can take the form of an organic iodide:

$$R—I \qquad \text{(IV)}$$

where R is an organic moiety providing a carbon to iodide bond.

In quantitative terms, the suitability of the R—I organic iodide releasing compound can be explained in terms of its low second order reaction rate constant in interacting with gelatino-vehicle. The second order reaction rate constant is less than $10^{-3}$ $mole^{-1}$-$sec^{-1}$.

The second order reaction rate constant is derived from the following relationship:

$$dI^-/dt=k[R—I][G—V] \qquad \text{(V)}$$

where k is the second order reaction rate constant;

dI/dt is the rate of iodide ion release, expressed in gram-atoms/second;

[R—I] is the molar concentration in moles per liter of R—I, defined above; and

[G—V] is the molar concentration in moles per liter of gelatino-vehicle. Instead of determining the actual molecular weight of the gelatino-vehicle employed (which is, of course, itself an average), a typical average molecular weight of a photographic gelatino-vehicle of $1\times10^5$ daltons can be alternatively employed.

The gelatino-vehicle, being an amino-acid polymer, contains numerous reaction sites. Divalent sulfur atoms, such as found in methionine, and trivalent nitrogen atoms provide iodide reaction sites. By partially pre-oxidizing the gelatino-vehicle it is possible to lower the rate at which the gelatino-vehicle reacts with any specific choice of R—I compound. A simpler method is simply to lower the molar concentration of the gelatino-vehicle until the desired second order rate constant level is reached. This is feasible, since only very low levels of gelatino-vehicle are required for peptizing the grains, and gelatino-vehicle required to function as a binder can be added after halide conversion has been completed.

Preferred organic moieties (R) are those that are relatively water soluble. Typically such compounds contain 10 or fewer carbon atoms. Although the iodide substituent itself promotes water solubility, at least one additional polar substituent is preferred to promote solubility, particularly when R contains three or more carbon atoms. Examples of suitable iodide ion releasing compounds include the following:

| | |
|---|---|
| IRC-1 | α-Iodoacetic acid |
| IRC-2 | α-Iodoacetamide |
| IRC-3 | Iodomethane |
| IRC-4 | Iodocyanomethane |
| IRC-5 | 1-Acetophenone |
| IRC-6 | 3-Iodopropanoic acid |
| IRC-7 | 4-Iodobutanoic acid |
| IRC-8 | 2-(Iodomethyl)pyridine |
| IRC-9 | Iodomethylbenzene |
| IRC-10 | 1-Iodo-2-hydroxypropane |
| IRC-11 | 2-Iodoethanol |
| IRC-12 | 3-Iodopropanol |
| IRC-13 | 4-Iodobutanol |
| IRC-14 | 1-hydroxy-1-phenyl-2-iodoethane |
| IRC-15 | 1,2-Dihydroxy-3-iodopropane |
| IRC-16 | 1-Hydroxy-2-iodocyclohexane |
| IRC-17 | 2,3-Dihydroxy-1,4-diiodobutane |
| IRC-18 | 1-Hydroxy-2-iodocyclopentane |
| IRC-19 | α-Iodo-α-phenylacetic acid |
| IRC-20 | α,α-Diiodoacetic acid |
| IRC-21 | Iodosuccinic acid |
| IRC-22 | 2-Hydroxy-1,3,-diiodopropane |
| IRC-23 | 1-Iodomethyl-4-methoxybenzene |
| IRC-24 | 2,4,5-Triiodoimidazole |
| IRC-25 | 1-Iodo-3-oxo-1-cyclohexene |
| IRC-26 | 5-Chloro-2,6-dioxo-1,3-dimethyl-4-iodo-1,3-diazine |
| IRC-27 | 2-Iodo-4-pyrone |
| IRC-28 | 1-Cyano-4-iodo-3-methylsulfobenzene |
| IRC-29 | 1-Iodomethyl-2,5-pyrrolidione |
| IRC-30 | 1-Iodomethyl-2,7-benzopyrrolidione |
| IRC-31 | 1-Iodomethylmorpholine |
| IRC-32 | 1,1-Dicyano-2-iodoethene |
| IRC-33 | ζ-iodohexanoic acid |
| IRC-34 | 1,2-Di(iodomethyl)benzene |
| IRC-35 | 2-Iodomethylphenol |
| IRC-36 | 4-Iodomethylbenzoic acid |
| IRC-37 | 3-Hydroxy-5-iodopentanol |
| IRC-38 | Methyl γ-iodopropanoate |
| IRC-39 | Ethyl α-iodoacetate |
| IRC-40 | 1-Iodomethylpyrazole |

Halide conversion can be undertaken at any temperature conventionally employed in silver halide emulsion precipitations—typically, from about 40° to 90° C.—and at any pH conventionally employed—typically, from about 2 to 10. It has been observed quite unexpectedly that the tabular grain integrity and photographic performance of the emulsions produced is highly improved when halide conversion is conducted at a pBr of less than 3.5. pBr is most preferably maintained at less than 2.5 and optimally at less than 2.0 during halide conversion. A minimum pBr for high bromide tabular grain precipitation is typically 0.6. Hence this represents a convenient lower pBr for halide conversion as well, although halide conversion at still lower pBr values is possible, if desired. If pBr is 3.0 or higher, it is contemplated to maintain pH on the acid side neutrality—that is, less than 7.

Studies of tabular grains that have undergone halide conversion according to the process of the invention reveal that dislocations are confined to corner regions of a large majority of the tabular grains—that is, in grains accounting for greater than 70 percent of total grain projected area. Typically, dislocations are confined to the corner regions of tabular grains accounting for greater than 90 percent of total grain projected area.

To be included among the tabular grains containing dislocations produced by halide conversion accounting for at least 70 percent of total grain projected area, each grain must retain corners joined by linear edges and contain dislocations produced by halide conversion confined to one or more corner regions. The present invention effectively eliminates degradation of tabular grain geometries by halide conversion. Dislocations on major faces of the tabular grains are avoided. Extensive edge degradation of the tabular grains is also avoided, such as evidenced by non-linear edges and obliteration of one or more grain corners present in the host tabular grains before halide conversion. Inspection has revealed that in a few instances tabular grains in the emulsions of the invention are observed that have dislocations produced by halide conversion that extend from a single corner region to adjacent portions of the tabular grains. These tabular grains are not counted among those satisfying the projected area criterion of this invention, even though they are believed to contribute at least to some extent in the superior photographic performance levels of observed. Photographic performance has been observed to improve as the tabular grains satisfying invention criteria account for progressively larger proportions of total grain projected area.

When halide conversion is completed, the proportion of iodide in the emulsions is increased. The converted halide emulsions of the invention are preferably limited to a maximum iodide concentration of 12 (optimally 5) mole percent, based on total silver. Higher levels of iodide inclusion are possible, but do not enhance photographic performance for the most commonly encountered photographic applications. At the other extreme, performance enhancements can be realized when silver bromide host tabular grain emulsions receive iodide by halide conversion to increase iodide ion concentrations to only 0.5 mole percent, based on total silver. In fact, only small amounts of iodide incorporation are required to improve the properties of the tabular grain emulsions chosen for halide conversion. It is preferred to increase the iodide concentration of the tabular grains by halide conversion by from 0.5 to 5 mole percent, optimally from 1.0 to 3 mole percent.

Subsequent to halide conversion the emulsions of the invention can be prepared for photographic use as described by *Research Disclosure*, 36544, cited above, I. Emulsion grains and their preparation, E. Blends, layers and performance categories; II. Vehicles, vehicle extenders, vehicle-like addenda and vehicle related addenda; III. Emulsion washing; IV. Chemical sensitization; and V. Spectral sensitization and desensitization, A. Spectral sensitizing dyes.

The emulsions or the photographic elements in which they are incorporated can additionally include one or more of the following features illustrated by *Research Disclosure*, Item 36544, cited above: VII. Antifoggants and stabilizers; VIII. Absorbing and scattering materials; IX. Coating physical property modifying addenda; X. Dye image formers and modifiers; XI. Layers and layer arrangements; XII. Features applicable only to color negative; XIII. Features applicable only to color positive; XIV. Scan facilitating features; and XV. Supports.

The exposure and processing of photographic elements incorporating the emulsions of the invention can take any convenient conventional form, illustrated by *Research Disclosure*, Item 36544, cited above, XVI. Exposure; XVIII. Chemical development systems; XIX. Development; and XX. Desilvering, washing, rinsing and stabilizing.

EXAMPLES

The invention can be better appreciated by reference to the following specific embodiments.

Emulsion A (Example)

In a 4-liter reaction vessel was placed an aqueous gelatin solution (composed of 1 liter of water, 0.56 g of alkali-processed low methionine gelatin, 3.5 ml of 4N nitric acid solution, 1.12 g of sodium bromide and having a pAg of 9.38 and 14.4 wt %, based on total silver used in nucleation, of PLURONIC-31R1™ (a surfactant satisfying the formula:

$$HO-(\underset{}{\overset{CH_3}{\overset{|}{CH}}}CH_2O)_y-(CH_2CH_2O)_x-(\overset{CH_3}{\overset{|}{CH}}CH_2O)_{y'}-H \quad \text{(VI)}$$

where x=7, y=25 and y'=25) while keeping the temperature thereof at 45° C. 14.83 ml of an aqueous solution of silver nitrate (containing 0.64 g of silver nitrate) and 14.83 ml of an aqueous solution of sodium bromide (containing 0.33 g of sodium bromide) were simultaneously added thereto over a period of 1 minute at a constant rate. The mixture was stirred for 1 minute during which 14.15 ml of an aqueous sodium bromide solution (containing 1.46 g of sodium bromide) was added at the 50 second point of the hold. Thereafter, after the 1 minute of mixing, the temperature of the mixture was raised to 60° C. over a period of 9 minutes. Then 16.7 ml of an aqueous solution of ammonium sulfate (containing 1.68 g of ammonium sulfate) were added, and the pH of the mixture was adjusted to 9.5 with aqueous sodium hydroxide (1N).

The mixture was stirred for 9 minutes. Then 83 ml of an aqueous gelatin solution (containing 16.7 g of alkali-processed gelatin) were added and the mixture was stirred for 1 minute, followed by a pH adjustment to 5.85 using aqueous nitric acid (1N). The mixture was stirred for 1 minute. Thereafter 30 ml of aqueous silver nitrate (containing 1.27 g of silver nitrate) and 32 ml of aqueous sodium bromide (containing 0.66 g of sodium bromide) were added simultaneously over a 15 minute period. Then 49 ml of aqueous silver nitrate (containing 13.3 g of silver nitrate) and 48.2 ml of aqueous sodium bromide (containing 8.68 g of sodium bromide) were added simultaneously at a constant ramp starting from respective rates of 0.67 ml/min and 0.72 ml/min for the subsequent 24.5 minutes. Then 468 ml of aqueous silver nitrate (containing 191 g of silver nitrate) and 464 ml of aqueous sodium bromide (containing 119.4 g of sodium bromide) were added simultaneously at constant ramp starting from respective rates of 1.67 ml/min and 1.70 ml/min for the subsequent 113.8 minutes.

A 1 minute hold while stirring followed. Then, while maintaining the emulsion at a pBr of 2.0, 40.3 g of a solution containing 11.54 grams of iodoacetic acid were added over a period of 3 minutes. The pH was adjusted up using 55.2 grams of 1N sodium hydroxide. After a 180 minute hold, the pH was readjusted to 5.85 using 1N nitric acid. Then 220.8 ml of an aqueous silver nitrate solution (containing 90.1 g of silver nitrate) were added over a 48.6 minute period using a linear ramp starting at a flow rate of 4.8 ml/min. Then, 11 minutes after the start of the silver nitrate, 164.2 ml of aqueous sodium bromide solution (containing 42.2 g of sodium bromide) were added using a matched ramp. The emulsion was then washed.

The washed silver halide emulsion contained 3.6 mole percent iodide, based on total silver. The properties of the grains of this emulsion are shown in Table I below.

Emulsion B (Comparison)

This emulsion was prepared similarly as Emulsion A, except that immediately before the introduction of the iodoacetic acid the pBr of the emulsion was increased to 3.75 as follows: 19.8 ml of silver nitrate solution (containing 8.072 g silver nitrate) were added at constant flow rate over a period of 11.8 minutes. Also, during the linear ramp of silver nitrate the aqueous sodium bromide was started 8 minutes after the silver nitrate addition started, and 170.3 ml of aqueous sodium bromide solution (containing 43.8 g of sodium bromide) were added using a matched ramp.

The washed silver halide emulsion contained 3.6 mole percent iodide, based on total silver. The properties of the grains of this emulsion are shown in Table I below.

TABLE I

Comparison of the Grain Properties

| Emulsion | Average Grain Size (microns) | Average Thickness (microns) | Average Aspect Ratio | COV (percent) |
|---|---|---|---|---|
| A | 1.59 | 0.13 | 12.3 | 9.1 |
| B | 1.65 | 0.13 | 12.7 | 10.2 |

Evaluation of Grain Morphology

Significant differences attributable to halide conversion were observed in the tabular grains of Emulsions A and B.

Tabular grains accounted for substantially all of the grain projected area in Emulsion A samples. The tabular grains exhibited hexagonal or triangular major faces. 167 of 175 tabular grains examined exhibited well formed {111} major faces of a hexagonal configuration with 6 well defined, sharp corners joined by 6 linear edges. This amounts to 95.4% of the grains. Dislocations were observed in the corner regions of the grains, but no dislocations were observed elsewhere in the grains, including the edge portions of the grains not included in the corner regions.

Examination of the tabular grains of Emulsion B revealed that 46 out of 102 (45.1%) of the tabular grains exhibited one or more rounded edges instead of the desired geometry of corner regions joined by linear edges. Where sharp corners remained in evidence, halide conversion dislocations confined to corner regions were observed. In portions of the degraded tabular grains showing rounded edges no dislocations were detected.

Photographic Comparison

The emulsions listed in Table I were optimally sensitized using two green sensitizing dyes in a weight ratio of 8.2 to 1. Dye D-1, anhydro-5,5'-dichloro-9-ethyl-3,3'-bis(3-sulfopropyl)oxacarbocyanine hydroxide triethylamine, was present in the larger amount, and Dye D-2, 3,9-diethyl-5-phenyl-3'-[N-(methylsulfonyl)carbamoylmethyl] benzothiazolooxacarbocyanine hydroxide, inner salt, was present in the smaller amount.

The sensitized emulsions were combined with a cyan-dye forming coupler, C-1, and coated on a photographic film support with a silver coverage of 807 mg/m$^2$ (75 mg/ft$^2$) and a coupler laydown double that of the silver coverage.

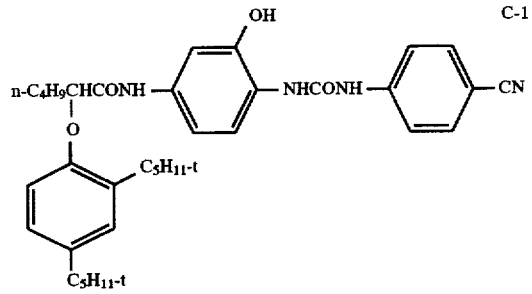

A sample of each coating was exposed with a tungsten light source for 1/50th second through a Wratten™ 9 filter (>460 nm transmission). Exposed film samples were developed for 3 minutes and 15 seconds using Kodak Flexicolor™ C-41 color negative processing. Speed is reported in relative log speed units. Each unit difference in relative speed represents 0.01 log E, where E represents speed in lux-seconds. Speed was measured at a density of 0.15 above fog.

TABLE II

Relative Speed

| Emulsion Example | Green-sensitized Wratten 9 exposure |
|---|---|
| A (invention) | 125 |
| B (comparative) | 100 |

The emulsion of the invention, Emulsion A, exhibited a large speed advantage. A speed difference of 30 is equal to a doubling in photographic speed. The speed of Emulsion A, representing the invention, was almost double that of the control, Emulsion B.

The invention has been described in detail with particular reference to preferred embodiments thereof, but it will be understood that variations and modifications can be effected within the spirit and scope of the invention.

What is claimed:

1. A halide conversion process comprised of providing a radiation-sensitive emulsion containing a gelatino-vehicle and silver halide grains and introducing iodide ions into the grains,

WHEREIN the radiation-sensitive emulsion as provided includes tabular grains which (a) are comprised at least 90 mole percent bromide and up to 10 mole percent iodide, based on silver, and (b) have {111} major faces that (i) form corners joined by linear edges and (ii) account for at least 70 percent of total grain projected area, the pBr of the emulsion provided is maintained at less than 3.5, an iodide ion source exhibiting a second order reaction rate constant with the gelatino-vehicle of less than $10^{-3}$ mole$^{-1}$ sec$^{-1}$ is introduced into the emulsion and reacted with the gelatino-vehicle to release iodide ions, and the released iodide ions selectively displace halide ions to create dislocations confined to corner regions of the tabular grains, the boundary between each corner region and the remainder of the tabular grain of which the corner region forms a part being delineated by a plane that perpendicularly intersects an axis extending from the center of a {111} major face of the tabular grain to the tabular grain corner within the corner region at a distance from the corner which is 10 percent of the length of the axis.

2. A halide conversion process according to claim 1 wherein the pBr of the emulsion is maintained at less than 3.0.

3. A halide conversion process according to claim 1 wherein the tabular grains of the emulsion provided for halide conversion contain up to 5 mole percent iodide, based on total silver.

4. A halide conversion process according to claim 1 wherein the tabular grains of the emulsion provided for halide conversion account for at least 90 percent of total grain projected area.

5. A halide conversion process according to claim 1 wherein the iodide ion source is a compound satisfying the formula:

*R—I* where R is an organic moiety providing a carbon to iodide bond.

6. A halide conversion process according to claim 5 wherein the organic moiety contains up to 10 carbon atoms and includes at least one polar substituent.

7. A radiation-sensitive emulsion containing a gelatino-vehicle and silver halide grains WHEREIN the grains include tabular grains accounting for at least 70 percent of total grain projected area comprised of, prior to halide conversion, at least 90 mole percent bromide and, after halide conversion, up to 12 mole percent iodide, based on total silver, having {111} major faces that form corners joined by linear edges, and containing halide conversion dislocations that are confined to corner regions, the boundary between each corner region and the tabular grain of which it forms a part being delineated by a plane that perpendicularly intersects an axis extending from the center of a {111} major face of the tabular grain to the tabular grain corner of the corner region at a distance from the corner which is 10 percent of the length of the axis.

8. A radiation sensitive emulsion according to claim 7 wherein the tabular grains account for at least 90 percent of total grain projected area.

9. A radiation sensitive emulsion according to claim 7 wherein the tabular grains contain up to 5 mole percent iodide, based on total silver.

10. A radiation sensitive emulsion according to claim 7 wherein the silver halide grains exhibit a coefficient of variation of less than 30 percent.

* * * * *

UNITED STATES PATENT AND TRADEMARK OFFICE

CERTIFICATE OF CORRECTION

Patent No.: 5,723,278

Issued: Mar. 3, 1998

Inventor(s): Seshadri Jagannathan
David E. Fenton
Samuel Chen

It is certified that error appears in the above-identified patent and that said Letters Patent is hereby corrected as shown below:

Title page, column 2, ABSTRACT line 4, delete "house" and substitute -- halide -- line 5, delete "house" and substitute -- halide --

Signed and Sealed this

Second Day of June, 1998

*Attest:*

*Attesting Officer*

BRUCE LEHMAN

*Commissioner of Patents and Trademarks*